US008139974B2

(12) United States Patent
Sakuwa

(10) Patent No.: US 8,139,974 B2
(45) Date of Patent: Mar. 20, 2012

(54) EXHAUST DEVICE, IMAGE FORMING APPARATUS INCLUDING THE SAME, RECORDING MEDIUM ON WHICH CONTROL PROGRAM FOR EXHAUST DEVICE IS RECORDED

(75) Inventor: Tohru Sakuwa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 168 days.

(21) Appl. No.: 12/769,869

(22) Filed: Apr. 29, 2010

(65) Prior Publication Data

US 2010/0290804 A1 Nov. 18, 2010

(30) Foreign Application Priority Data

May 14, 2009 (JP) ..... 2009-118055

(51) Int. Cl.
*G03G 21/20* (2006.01)
*G03G 15/00* (2006.01)

(52) U.S. Cl. ..... 399/92; 399/43; 399/94

(58) Field of Classification Search ..... 399/43, 399/92, 93, 94, 98
See application file for complete search history.

(56) References Cited

U.S. PATENT DOCUMENTS

| | | | | |
|---|---|---|---|---|
| 5,155,531 | A | 10/1992 | Kurotori et al. | |
| 7,269,374 | B2 * | 9/2007 | Oka | 399/94 |
| 7,466,934 | B2 * | 12/2008 | Chae et al. | 399/69 |
| 7,623,822 | B2 * | 11/2009 | Matsuno | 399/400 |

FOREIGN PATENT DOCUMENTS

| | | | |
|---|---|---|---|
| JP | 61-62089 | A | 3/1986 |
| JP | 03-116163 | | 5/1991 |
| JP | 05-269340 | | 10/1993 |
| JP | 08-069243 | A | 3/1996 |
| JP | 11-184179 | A | 7/1999 |
| JP | 2004-287316 | | 10/2004 |
| JP | 2004-325994 | | 11/2004 |

* cited by examiner

*Primary Examiner* — Hoang Ngo
(74) *Attorney, Agent, or Firm* — Renner, Otto, Boisselle & Sklar, LLP

(57) ABSTRACT

An exhaust device provided in an image forming apparatus is provided. In the exhaust device, an initial condition setting unit sets an initial drive output value of a exhaust fan at a time of starting an image forming operation based on a calculation value calculated by an image bearing member drive counting unit. A drive unit drives the exhaust fan to start to discharge air in the image forming apparatus. A continuation condition setting unit sets a continuation drive condition at a time of continuously driving the exhaust fan from a point in time when ending the image forming operation based on a count value of the number of image formation by the job counting unit 303*a*. A drive unit drives the exhaust fan with the continuation drive condition to continuously discharge the air in the image forming apparatus.

8 Claims, 8 Drawing Sheets

EXHAUST DEVICE, IMAGE FORMING APPARATUS INCLUDING THE SAME, RECORDING MEDIUM ON WHICH CONTROL PROGRAM FOR EXHAUST DEVICE IS RECORDED

CROSS-REFERENCE TO RELATED APPLICATION

This application claims priority to Japanese Patent Application No. 2009-118055, which was filed on May 14, 2009, the contents of which are incorporated herein by reference in its entirety.

BACKGROUND OF THE INVENTION

1. Field of the Invention

The present invention relates to an exhaust device for discharging air in an image forming apparatus to an outside of the image forming apparatus and an image forming apparatus provided with the same, and to a computer readable recording medium on which a control program for the exhaust device is recorded.

2. Description of the Related Art

In electrophotographic image forming apparatuses such as copiers, printers, and facsimiles, a photoreceptor provided with a photosensitive layer including a photoconductive material on a surface thereof as an image bearing member is used, electric charges are applied onto the surface of the photoreceptor to uniformly charge the surface by a charging device, an electrostatic latent image corresponding to image information by various image forming processes is formed, the electrostatic latent image is developed into a visible image by a developer including a toner supplied from a development device, the visible image is transferred onto a recording medium such as paper, it is heated and pressurized by a fixing roller to fix it to the recording material, thereby forming an image on the recording material.

There is a case where a brush-shaped or roller-shaped contact-type device used in contact with a target is used as a charging device and a transfer device, but the roller-shaped or brush-shaped charging device and transfer device come into contact with a photoreceptor, an intermediate transfer belt, or similar to cause abrasion deterioration of the photoreceptor or the intermediate transfer belt. For this reason, recently, there are many cases where the contact-type charging device, transfer device, and similar are employed in an image forming apparatus with a relatively low printing speed, and a corona charging device (of scorotron charger type, etc.) is employed in an image forming apparatus with a high printing speed.

The corona charging device is suitable for image forming apparatus with the high printing speed, but it is difficult to avoid generating a discharge product such as ozone ($O_3$) and nitrogen oxide ($NO_x$) in the device. Specifically, nitrogen molecules ($N_2$) in the air are dissociated into nitrogen elements (N) by energy based on discharge of electrons emitted from the corona charging device, and the nitrogen elements are bonded to oxygen molecules ($O_2$), thereby generating nitrogen oxides (nitrogen dioxides: $NO_2$). Similarly, oxygen molecules ($O_2$) in the air are dissociated into oxygen elements (O), and the oxygen elements are bonded to oxygen molecules ($O_2$), thereby generating ozone ($O_3$).

When the ozone with high concentration is generated in the image forming apparatus as described above, the photoreceptor deteriorates through intensive oxidization of the ozone, and deterioration of image quality of printing (such as pinhole) may occur. When the nitrogen oxides are generated in the image forming apparatus, products based on the nitrogen oxides are attached onto the surface of the photoreceptor to diffuse the electric charges of the photoreceptor, and deterioration of image quality of printing (such as pinhole) may occur.

To solve such problems, the image forming apparatus is provided with an exhaust device that compulsorily discharges the ozone and discharge products in the apparatus with the air out the apparatus. In addition, the exhaust device may be provided therein with an ozone decomposition filter to lower the concentration of the ozone discharged to the outside of the image forming apparatus.

Japanese Unexamined Patent Publication JP-A 5-269340 (1993) discloses an exhaust device in which a continuation drive time at the time of continuously driving an exhaust unit from the point in time when ending a printing operation in an image forming apparatus is controlled according to the number of printing copies of one job. As described in JP-A 5-269340, when the continuation drive time of the exhaust unit is controlled according to the number of printing copies of one job, it is possible to discharge the ozone and discharge products in the image forming apparatus, concentrations of which become high substantially in proportion to the number of printing copies, out of the apparatus. Japanese Unexamined Patent Publication JP-A 2004-325994 discloses an exhaust device in which a drive time of an exhaust unit discharging the ozone in an image forming apparatus out of the apparatus is controlled according to use circumstance conditions (such as humidity condition).

However, a deterioration degree of image quality of printing such as pinhole caused by the ozone and discharge products in the image forming apparatus are varied according to the number of printing copies of one job and the use circumstance conditions, and is varied depending on a deterioration degree of a photoreceptor. For this reason, in the exhaust devices disclosed in JP-A 5-269340 and JP-A 2004-325994 in which the continuation drive time of the exhaust unit is controlled according to only the number of printing copies of one job or the use circumstance conditions, the deterioration of image quality of printing caused by the ozone and discharge products cannot be sufficiently suppressed. On the contrary, in order to sufficiently suppress the deterioration of image quality of printing, it is necessary to start to drive the exhaust unit with a drive output value set high to obtain high exhaust capability, and unnecessary power consumption cannot be suppressed.

SUMMARY OF THE INVENTION

An object of the invention is to provide an exhaust device efficiently discharging the ozone and discharge products in an image forming apparatus to suppress the deterioration of image quality of printing and to suppress unnecessary power consumption, and an image forming apparatus provided with the exhaust device. Another object of the invention is to provide a computer-readable recording medium on which a control program for the exhaust device is recorded.

The invention provides an exhaust device provided in an image forming apparatus having an image forming unit which form an image on a recording material by transferring a toner image borne on an image bearing member to the recording material, the exhaust device comprising:

an exhaust unit that discharge air in the image forming apparatus to an outside of the image forming apparatus by generating an air current flowing from an inside to an outside of the image forming apparatus;

a drive unit that drives the exhaust unit; and an exhaust control unit that controls the drive unit to drive the exhaust unit, the exhaust control unit including:

a job counting unit that counts a number of image formation of one job in an image forming operation performed onto the recording material by the image forming unit, an image bearing member drive counting unit that integrates count values counted by the job counting unit from a point in time when starting the use of the image bearing member and calculates a number of driving times of the image bearing member, and an initial condition setting unit that sets an initial drive output value of the exhaust unit driven by the drive unit at a time of starting the image forming operation performed onto the recording material by the image forming unit based on a calculation value calculated by the image bearing member drive counting unit, the exhaust unit being controlled to be driven with the initial drive output value set by the initial condition setting unit at the time of starting the image forming operation performed onto the recording material by the image forming unit.

According to the invention, the exhaust device comprises the exhaust control unit that controls the exhaust unit that discharges the air in the image forming apparatus to the outside of the image forming apparatus. The exhaust control unit includes the job counting unit that counts the number of image formation of one job, the image bearing member drive counting unit that calculates the number of driving times of the image bearing member from the point in time when the use starts, and the initial condition setting unit. In the exhaust device, the initial condition setting unit sets the initial drive output value of the exhaust unit at the time of starting the image forming operation based on the calculation value calculated by the image bearing member drive counting unit, and the drive unit drives the exhaust unit with the initial drive output value, the exhaust device starts to discharge the air in the image forming apparatus. Accordingly, the exhaust capability of the exhaust device at the time of starting the image forming operation are controlled according to the deterioration degree of the image bearing member, the deterioration of image quality of printing varied depending on the deterioration degree of the image bearing member can be suppressed, and the unnecessary power consumption can be suppressed.

Furthermore, in the invention, it is preferable that the exhaust control unit further includes a continuation condition setting unit that sets a continuation drive condition at a time of continuously driving the exhaust unit from a point in time when ending an image forming operation performed onto the recording material by the image forming unit based on a count value counted by the job counting unit, and controls the exhaust unit to be continuously driven from the point in time when ending the image forming operation under the continuation drive condition set by the continuation condition setting unit.

According to the invention, the exhaust control unit further includes the continuation condition setting unit. In the exhaust device, the continuation condition setting unit sets the continuation drive condition at the time of continuously driving the exhaust unit from the point in time when ending the image forming operation based on the count value of the number of image formation of one job counted by the job count unit, and the drive unit drives the exhaust unit under the continuation drive condition to continue discharging the air in the image forming apparatus. Accordingly, the exhaust capability of the exhaust device from the point in time when ending the recording operation is controlled according to the number of image formation, and the deterioration of image quality of printing varied according to the number of image formation and caused by the ozone and discharge products can be suppressed.

Furthermore, in the invention, it is preferable that the initial condition setting unit sets the initial drive output value of the exhaust unit driven by the drive unit to raise the exhaust capability of the exhaust unit in a stepwise fashion as the calculation value calculated by the image bearing member drive counting unit gets larger and the continuation condition setting unit sets the continuation drive condition of the exhaust unit driven by the drive unit to raise the exhaust capability of the exhaust unit in a stepwise fashion as the count value counted by the job counting unit gets larger.

According to the invention, in the exhaust device, the initial condition setting unit sets the initial drive output value of the exhaust device to raise the exhaust capability of the exhaust unit in a stepwise fashion as the calculation value calculated by the image bearing member drive counting unit gets larger. Accordingly, the exhaust device can keep the image quality of printing, the deterioration degree of which gets larger as the deterioration degree of the image bearing member gets larger, with high quality. In the exhaust device, the continuation condition setting unit sets the continuation drive condition of the exhaust unit to raise the exhaust capability of the exhaust unit in a stepwise fashion as the count value of the number of image formation counted by the job counting unit gets larger. Accordingly, the exhaust device can keep the image quality of printing, the deterioration degree of which gets larger as the number of image formation gets larger, with high quality.

Furthermore, in the invention, it is preferable that the continuation condition setting unit sets the continuation drive time of continuously driving the exhaust unit from the point in time when ending the image forming operation performed onto the recording material by the image forming unit, as the continuation drive condition.

According to the invention, in the exhaust device, the continuation condition setting unit sets the continuation drive time of continuously driving the exhaust unit from the point in time when ending the image forming operation, as the continuation drive condition, and the drive unit drives the exhaust unit during the set continuation drive time. Accordingly, the exhaust device can suppress the deterioration of image quality of printing varied according to the number of image formation and caused by the ozone and discharge products, with a simple configuration of turning on or off the drive of the exhaust unit.

Furthermore, in the invention, it is preferable that the continuation condition setting unit sets the continuation drive output value of the exhaust unit driven by the drive unit at the time of continuously driving the exhaust unit from the point in time when ending the image forming operation performed onto the recording material by the image forming apparatus, as the continuation drive condition.

According to the invention, in the exhaust device, the continuation condition setting unit sets the continuation drive output value of the exhaust unit as the continuation drive condition, and the drive unit drives the exhaust unit with the set continuation drive output value. Accordingly, the exhaust device can suppress the deterioration of image quality of printing varied according to the number of image formation caused by the ozone and discharge products, with a simple configuration capable of controlling the exhaust capability of the exhaust unit according to the setting of the continuation drive output value.

Furthermore, in the invention, it is preferable that the continuation condition setting unit sets the continuation drive time of continuously driving the exhaust unit from the point in time when ending the image forming operation performed onto the recording material by the image forming unit, and the continuation drive output value of the exhaust unit driven by the drive unit, as the continuation drive condition.

According to the invention, in the exhaust device, the continuation condition setting unit sets the continuation drive time of continuously driving the exhaust unit from the point in time when the image forming operation ends, and the continuation drive output value of the exhaust unit, as the continuation drive condition. The drive unit drives the exhaust unit during the set continuation drive time with the set continuation drive output value. Accordingly, the exhaust device has a configuration capable of controlling the exhaust capability of the exhaust unit according to the plurality of settings of the continuation drive time and the continuation drive output value, and can efficiently suppress the deterioration of image quality of printing varied according to the number of image formation and caused by the ozone and discharge products.

The invention provides an image forming apparatus provided with the exhaust device mentioned above.

According to the invention, the image forming apparatus is provided with the exhaust device mentioned above, can form an image of high quality, and can suppress unnecessary power consumption.

The invention provides a computer-readable recording medium on which a control program for causing a computer to function as the exhaust control unit provided in the exhaust device mentioned above is recorded.

According to the invention, the control program is a program for causing the computer to function as the exhaust control unit provided in the exhaust device mentioned above. Such a control program realizes the exhaust device by the computer.

Furthermore, the recording medium is realized as a computer-readable medium on which the control program mentioned above is recorded. A general-purpose computer such as a personal computer reads the control program recorded in the recording medium, thereby suppressing the deterioration of image quality of printing caused by the ozone and discharge products and suppressing unnecessary power consumption.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
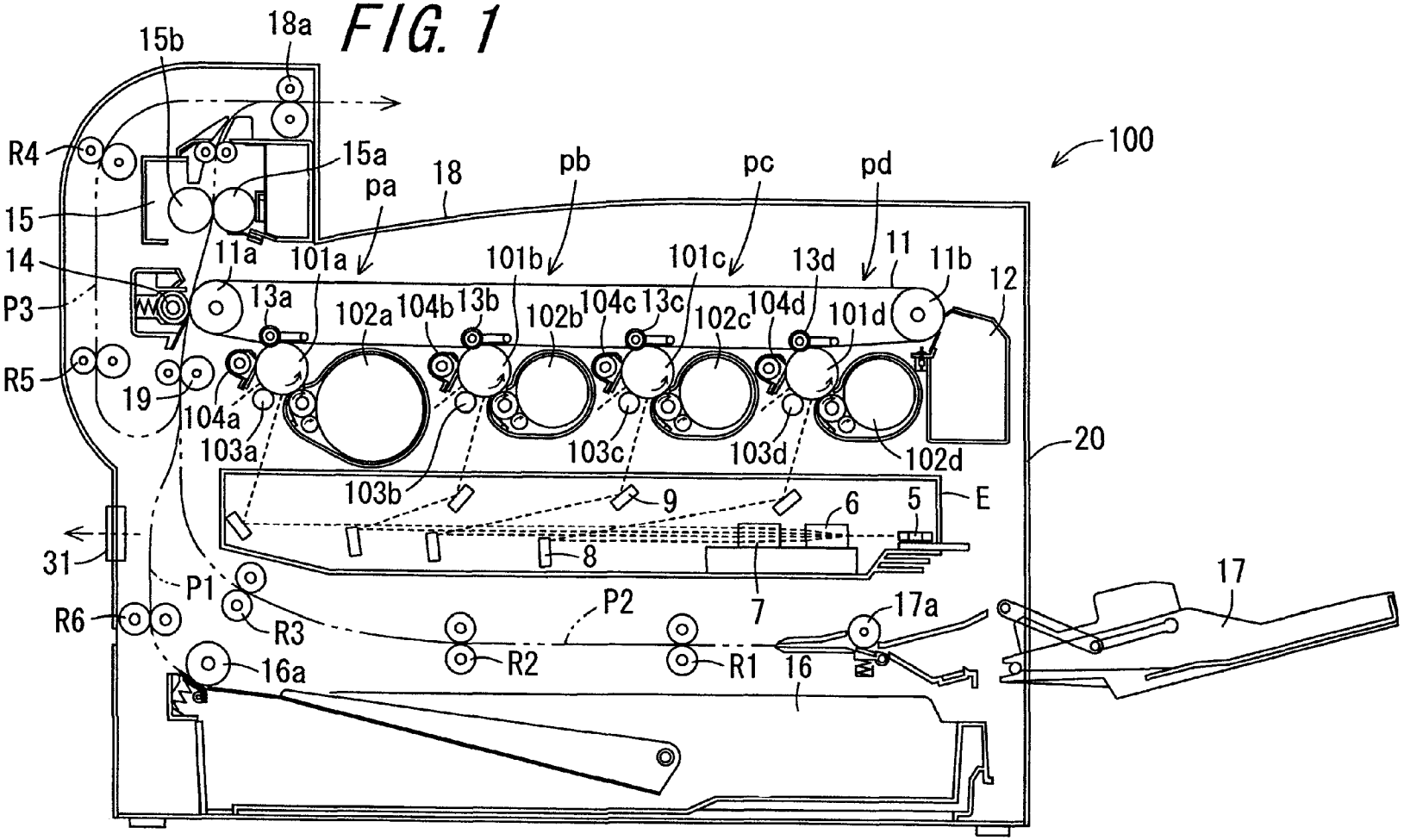
FIG. 1 is a diagram illustrating a configuration of an image forming apparatus provided with an exhaust device according to an embodiment of the invention.

Now referring to the drawings, preferred embodiments of the invention are described below.

(Image Forming Apparatus)

Figure 2:
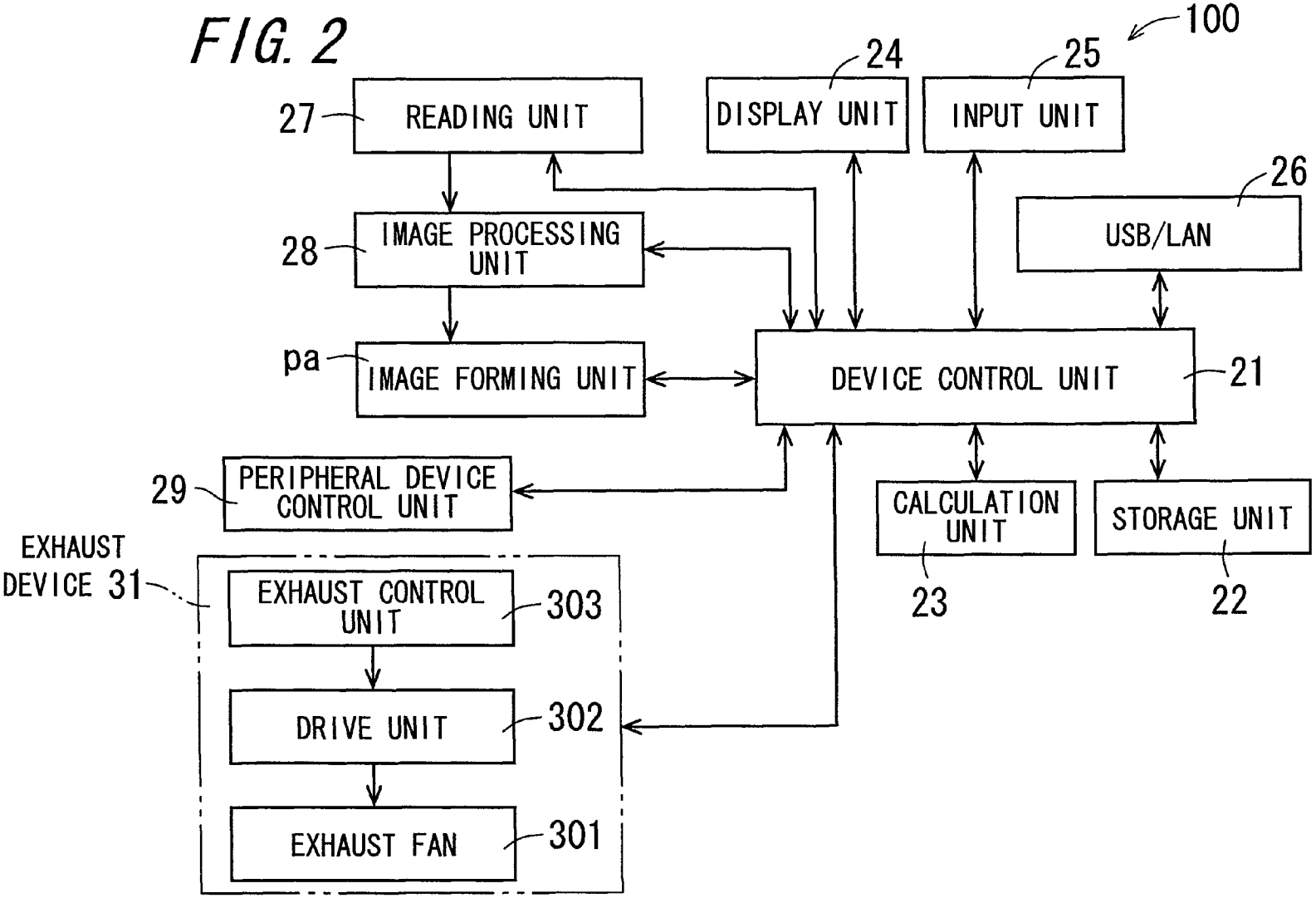
FIG. 2 is a block diagram illustrating an electrical configuration of the image forming apparatus.

FIG. 1 is a diagram illustrating a configuration of an image forming apparatus 100 provided with an exhaust device 31 according to an embodiment of the invention. FIG. 2 is a block diagram illustrating an electrical configuration of the image forming apparatus 100.

A laser printer which forms a multi-color or single-color image on a recording material such as paper based on image data inputted from the outside or image data obtained by reading a document will be described as an example of the image forming apparatus 100.

As shown in FIG. 1 and FIG. 2, the image forming apparatus 100 is provided with an exposure unit E, four image forming units pa, pb, pc, and pd, an intermediate transfer belt 11, a secondary transfer unit 14, a fixing unit 15, an internal paper feeding unit 16, an manual paper feeding unit 17, a paper discharging unit 18, and a frame 20 housing such units.

The image forming apparatus 100 forms an image in the image forming units pa to pd using image data corresponding to four colors of black (K), as well as cyan (C), magenta (M) and yellow (Y) as three subtractive primary colors which can be obtained by chromatically separating a color image. The image forming units pa to pd are arranged in a line in a movement direction (a sub-scanning direction perpendicular to a main scanning direction) of the intermediate transfer belt 11.

In the embodiment, the image forming apparatus using the four-color toner is described as the image forming apparatus, but the invention is not particularly limited thereto, and the image forming apparatus may use six color toners by adding light cyan (LC) and light magenta (LM).

The image forming unit pa has a photoreceptor 101*a*, a charging unit 103*a*, a development unit 102*a*, a cleaning unit 104*a*, and a primary transfer unit 13*a*. The photoreceptor 101*a* is an image bearing member, and the charging unit 103*a*, the development unit 102*a*, and the cleaning unit 104*a* are disposed around the photoreceptor 101*a*. The primary transfer unit 13*a* is disposed in pressure-contact with the photoreceptor 101*a* with the intermediate transfer belt 11 interposed therebetween. The other three image forming units pb, pc, and pd have the same configuration as that of the image forming unit pa, and toners of yellow (Y), magenta (M), cyan (C), and black (K) are accommodated in the development units 102*a* to 102*d* of the units.

The photoreceptor 101*a* has a cylindrical shape, and is rotated by drive force transmitted from a drive source (not shown). The photoreceptor 101*a* has a cylindrical conductive substrate, and a photosensitive layer provided on a surface of the conductive substrate.

The charging unit 103*a* is disposed in an axial direction of the photoreceptor 101*a* to face a surface of the photoreceptor 101*a*. The charging unit 103*a* is a noncontact-type charging device, and electrically charges the surface of the photoreceptor 101*a* uniformly with predetermined potential.

The exposure unit E is provided with a semiconductor laser (not shown), a polygon mirror 6, a first fθ lens 7, a second fθ lens 8, and similar, and irradiates the photoreceptors 101*a* to 101*d* with laser beams modulated by image data corresponding to colors of black, cyan, magenta, and yellow. Electrostatic latent images based on the image data corresponding to colors of black, cyan, magenta, and yellow are formed on the photoreceptor 101*a* to 101*d*, respectively.

The development unit 102*a* accommodates a black developer therein. The developer includes a toner and an external additive. The external additive improves fluidity of the toner. The development unit 102*a* supplies the black developer onto the surface of the photoreceptor 101*a* on which the electrostatic latent image is formed, to develop the electrostatic latent image into a toner image.

A general toner used in the field of an electrophotographic image forming apparatus is used as the toner. For example, the toner includes a binder resin, a colorant, a charge control agent, a release agent, and the like. A fluidity improving agent is used as the external additive. Specifically, silica, titanium oxide, silicon carbide, aluminum oxide, or the like is used as the fluidity improving agent. The fluidity improving agent may be one whose surface is subjected to a hydrophobization treatment by, for example, polyorganosiloxane having a trimethylsilyl group. It is preferable that silica, for example, is subjected to the hydrophobization treatment. As the fluidity improving agent, these materials may be used each alone, and two or more of materials may be used in combination. The amount of the external additive used in the toner is not particularly limited, but it is preferable that the amount of the external additive used falls within a range of 0.1 to 3.0 by weight based on 100 parts by weight of the toner.

The cleaning unit 104*a* removes and collects the toner remaining on the surface of the photoreceptor 101*a* after development and image transfer.

The intermediate transfer belt 11 is supported around a driving roller 11*a* and a driven roller 11*b* with tension and forms a loop-shaped movement path. An outer peripheral surface of the intermediate transfer belt 11 faces the photoreceptor 101*d*, the photoreceptor 101*c*, the photoreceptor 101*b*, and the photoreceptor 101*a*, in this order. The primary transfer units 13*a* to 13*d* are disposed at positions facing the photoreceptors 101*a* to 101*d* with the intermediate transfer belt 11 interposed therebetween, respectively. The positions of the intermediate transfer belt 11 facing the photoreceptors 101*a* to 101*d* are primary transfer positions.

A primary transfer bias of a polarity reverse to an electrical charge polarity of the toner is applied to the primary transfer units 13*a* to 13*d* under constant voltage control, to transfer the toner images borne on the surfaces of the photoreceptors 101*a* to 101*d* onto the intermediate transfer belt 11. Accordingly, the toner images with the colors formed on the photoreceptors 101*a* to 101*d* are transferred and overlaid on top of each other onto the outer peripheral surface of the intermediate transfer belt 11 to form a full-color toner image on the outer peripheral surface of the intermediate transfer belt 11.

When image data of only a part of yellow, magenta, cyan, and black is inputted, among the four photoreceptors 101*a* to 101*d*, an electrostatic latent image and a toner image are formed only at ones corresponding to the colors of the inputted image data. For example, at the time of forming a monochromatic image, an electrostatic latent image and a toner image are formed only at the photoreceptor 101*a* corresponding to the black color, and only the black toner image is transferred onto the outer peripheral surface of the intermediate transfer belt 11.

The primary transfer units 13*a* to 13*d* are formed by coating surfaces of shafts made of metal with a diameter of 8 to 10 mm (e.g., stainless steel) with conductive elastic materials (e.g., EPDM: ethylene propylene diene monomer rubber, urethane foam, etc.), and high voltage is uniformly applied to the intermediate transfer belt 11 through the conductive elastic materials.

The toner images transferred onto the outer peripheral surface of the intermediate transfer belt 11 at the primary transfer positions are transported to a secondary transfer position facing the secondary transfer unit 14 by the rotation of the intermediate transfer belt 11. At the time of forming an image, an inner peripheral surface of the secondary transfer unit 14 is in pressure-contact with the outer peripheral surface of the intermediate transfer belt 11 being in contact with a peripheral surface of the driving roller 11*a*, with a predetermined nip pressure.

When a recording sheet of paper (recording material) fed from the internal paper feeding unit 16 or the manual paper feeding unit 17 passes between the secondary transfer unit 14 and the intermediate transfer belt 11, a high voltage of a polarity reverse to the electrical charge polarity of the toner is applied to the secondary transfer unit 14. Accordingly, the toner image is transferred from the outer peripheral surface of the intermediate transfer belt 11 onto the surface of the recording sheet of paper.

The toner, which is not transferred to the recording sheet of paper and remains on the intermediate transfer belt 11, of the toner attached from a part or all of the photoreceptors 101*a* to 101*d* to the intermediate transfer belt 11 is collected by the cleaning unit 12 to prevent colors from being mixed in the next process.

The fixing unit 15 has a fixing roller 15*a* and a pressure roller 15*b*. The recording sheet of paper to which the toner image is transferred, is led to the fixing unit 15 and passes between the fixing roller 15*a* and the pressure roller 15*b*, thereby heating and pressurizing the recording sheet of paper. Accordingly, the toner image is strongly fixed to the surface of the recording sheet of paper. The recording sheet of paper to which the toner image is fixed, is discharged onto the paper discharging unit 18 by a paper discharging roller 18*a*.

The image forming apparatus 100 is provided with a substantially vertical paper conveyance path P1 for conveying the recording sheet of paper accommodated in the internal paper feeding unit 16 to the paper discharging unit 18 between the secondary transfer unit 14 and the intermediate transfer belt 11 by way of the fixing unit 15.

A pickup roller 16*a* that sends out the recording sheets of paper in the internal paper feeding unit 16 sheet by sheet into the paper conveyance path P1 and conveying rollers R6 that can changes freely a rotation rate at which the sent-out recording sheets of paper are conveyed along the paper conveyance path P1, are disposed on, the paper conveyance path P1. Registration rollers 19 that leads the conveyed recording sheet of paper to a part between the secondary transfer unit 14 and the intermediate transfer belt 11 at a predetermined timing, and the paper discharging roller 18*a* that discharges the recording sheet of paper to the paper discharging unit 18, are disposed on the paper conveyance path P1.

The image forming apparatus 100 is provided with a paper conveyance path P2 from the manual paper feeding unit 17 to the registration rollers 19. Similarly to the configuration of the paper conveyance path P1, a pickup roller 17*a* that sends out the recording sheets of paper disposed in the manual paper feeding unit 17 sheet by sheet into the paper conveyance path P2, and conveying rollers R1, R2 and R3, are disposed on the paper conveyance path P2.

A paper conveyance path P3 is formed from the paper discharging roller 18*a* to the upstream side of the registration rollers 19 on the paper conveyance path P1. The paper discharging roller 18*a* is rotatable in the forward and reverse directions, and is driven in the forward-rotation direction to discharge the sheet of paper to the paper discharging unit 18 at the time of a one-side image forming operation of forming an image on one side of the recording sheet of paper, and at the time of a second-side image formation in the two-side image forming operation of forming images on both faces of the recording sheet of paper.

At the time of a first-side image formation in the two-side image forming operation, the paper discharge roller 18*a* is driven in the forward-rotation direction until the tail end of the recording sheet of paper passes through the fixing unit 15 and then is driven in the reverse-rotation direction with the tail end pinched therebetween to guide the recording sheet of paper into the paper conveyance path P3. Conveying rollers R4 and R5 are disposed on the paper conveyance path P3. Accordingly, the recording sheet of paper, the image is formed on only one side of which at the time of the two-side image forming operation, is guided to the paper conveyance path P1, with the front and back sides and the leading and tail ends reversed.

The registration rollers 19 lead the recording sheet of paper fed from the internal paper feeding unit 16 and mainly from the manual paper feeding unit 17, or the recording sheet of paper conveyed through the paper conveyance path P3, to a part between the secondary transfer unit 14 and the intermediate transfer belt 11 at a timing synchronizing with the rotation of the intermediate transfer belt 11. For this reason, the registration rollers 19 stop rotating at the time of starting the operation of the photoreceptor 101*a* or the intermediate transfer belt 11, and the recording sheet of paper fed or transported before the rotation of the intermediate transfer belt 11 stops moving on the paper conveyance path P1 with the leading end thereof being in contact with the registration rollers 19. Then, the registration rollers 19 start to rotate when the leading end of the recording sheet of paper faces the leading end of the toner image formed on the intermediate transfer belt 11, at the position where the secondary transfer unit 14 is in pressure-contact with the intermediate transfer belt 11.

At the time of the full-color image formation in which an image is formed by all the image forming units pa to pd, the primary transfer units 13*a* to 13*d* bring the intermediate transfer belt 11 into pressure-contact with all the photoreceptors 101*a* to 101*d*. At the time of monochromatic image formation in which an image is formed only by the image forming unit pa, only the primary transfer unit 13*a* brings the intermediate transfer belt 11 into pressure-contact with the photoreceptor 101*a*.

As shown in FIG. 2, the image forming apparatus 100 includes a device control unit 21, a storage unit 22, and a calculation unit 23. The device control unit 21 overall controls the image forming operation in the image forming apparatus 100.

The storage unit 22 stores printing instructions inputted through an operation panel (display unit 24, and input unit 25) disposed on an upper face of the image forming apparatus 100, detection result from various sensors disposed at parts in the image forming apparatus 100, image information inputted from external devices through a USB/LAN 26, various setting values and data tables for controlling operations of the units in the image forming apparatus 100, programs for executing various controls, and the like. As the storage unit 22, device generally used in this field may be used, for example, a read-only memory (ROM), a random access memory (RAM), a hard disc drive (HDD), and the like. As the external devices, electrical and electronic devices which can form or acquire image information and can be electrically connected to the image forming apparatus 100 may be used, for example, a computer, a digital camera, and the like.

The calculation unit 23 takes out the various kinds of data (printing instructions, detection results, image information, etc.) and the programs for executing the various controls stored in the storage unit 22, and performs various detections and/or determinations. The device control unit 21 transmits a control signal to the unit corresponding to the various determination results and calculation results in the calculation unit 23, and performs an operation control.

The device control unit 21 and the calculation unit 23 are processing circuits realized by a microcomputer, a microprocessor, and the like, which are provided with a central processing unit (CPU).

The image forming apparatus 100 is a multifunction printer provided with, for example, a scanner, a printer, and peripheral devices, and comprises a reading unit 27 that reads a document image, an image processing unit 28 that converts the read document image into a proper electrical signal and generates image data, and a peripheral device control unit 29 that controls peripheral devices such as the image forming units pa to pd developing the generated image data using the toners and forming an image on the recording sheet of paper, a finisher and a sorter which serve as a postprocessor.

In the image forming apparatus 100 according to the embodiment, a scorotron-type charging device is employed as the charging unit 103*a*. Accordingly, since the ozone and discharge products are generated around at least four image forming units pa, pb, pc, and pd, the exhaust device 31 discharging them out of the apparatus is provided in an opening formed at a side portion of the frame 20 of the image forming apparatus 100.

(Exhaust Device)

Figure 3:
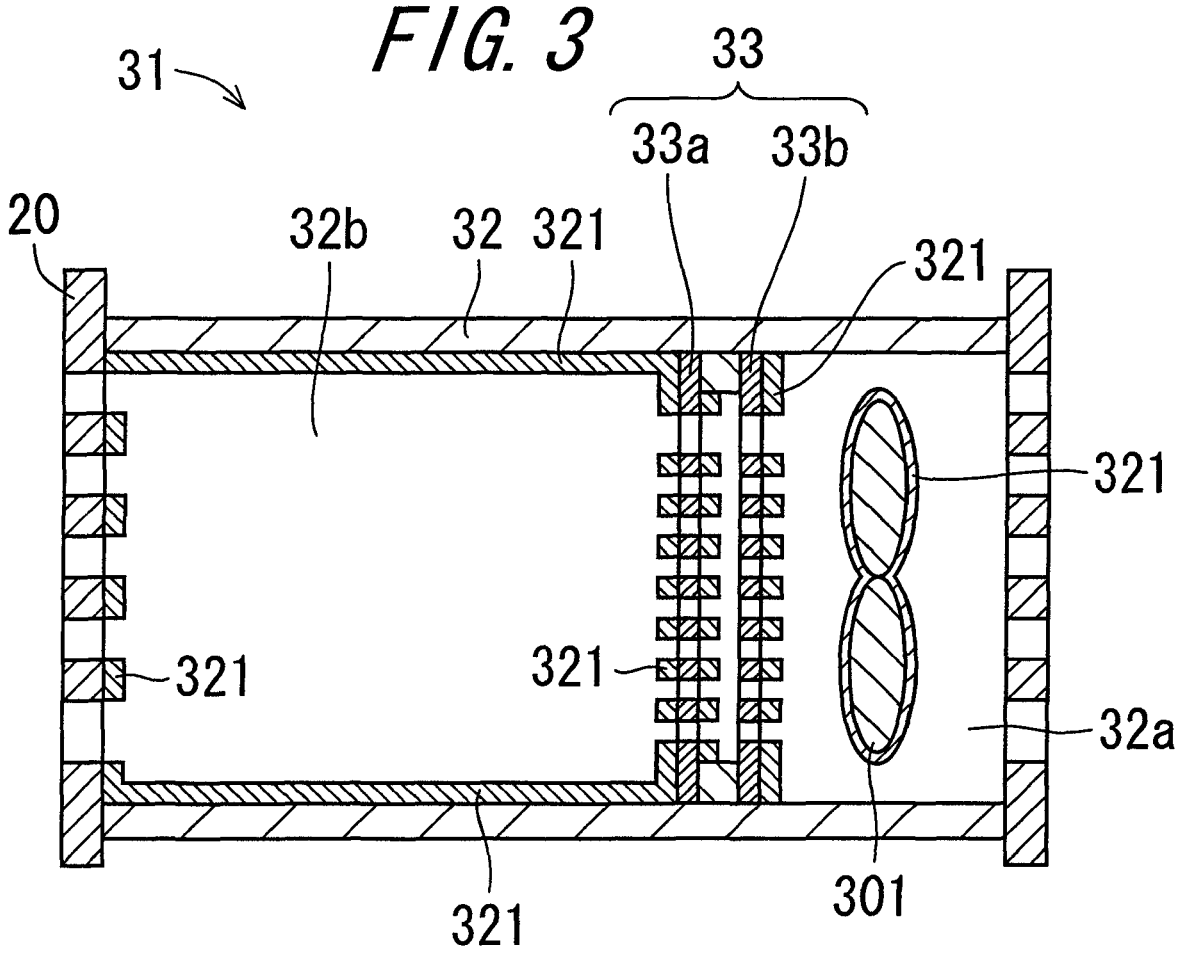
FIG. 3 is a diagram illustrating a configuration of the exhaust device.
Figure 4:
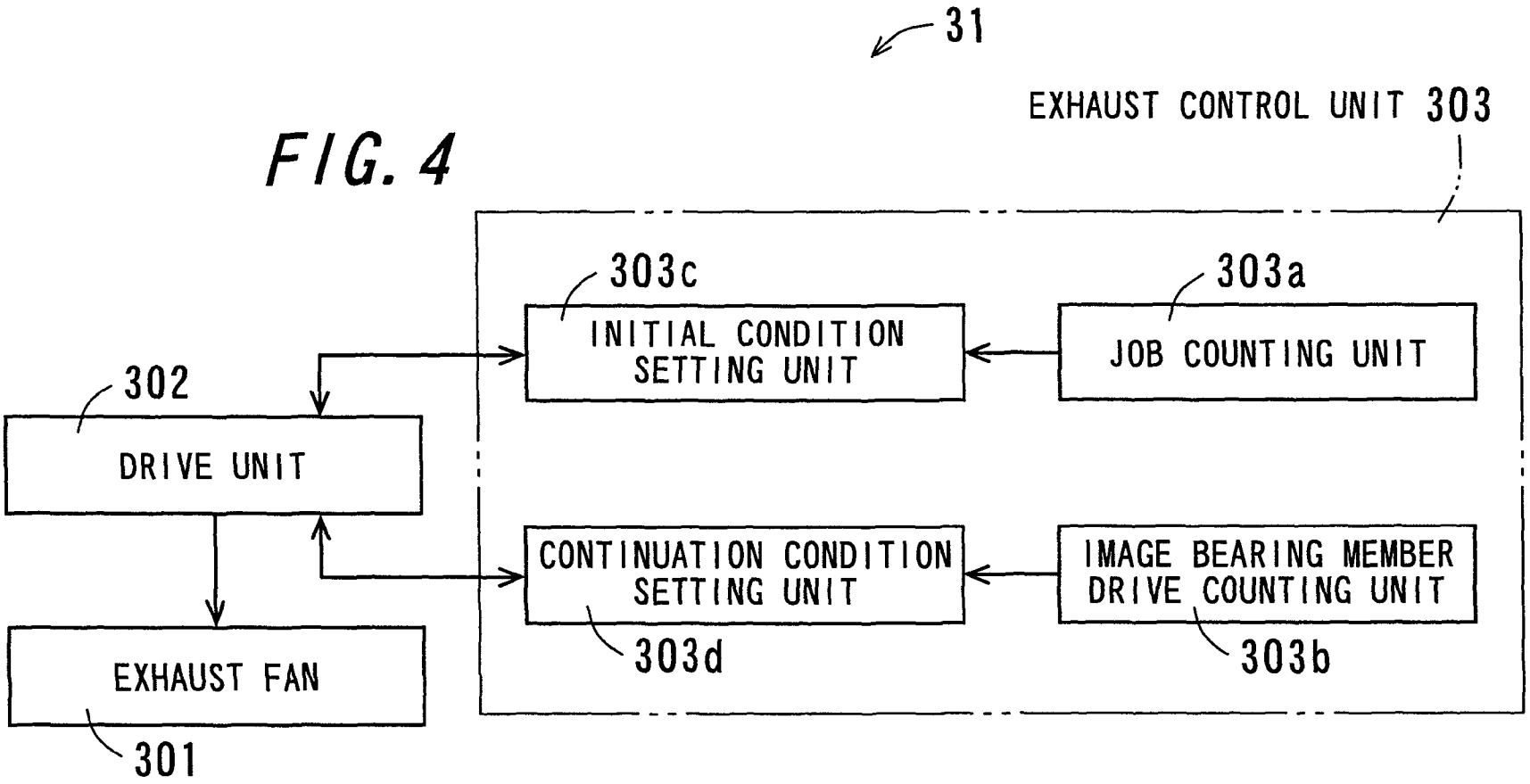
FIG. 4 is a block diagram illustrating an electrical configuration of the exhaust device.

FIG. 3 is a diagram illustrating a configuration of the exhaust device 31. FIG. 4 is a block diagram illustrating an electrical configuration of the exhaust device 31. The exhaust device 31 comprises an exhaust duct 32 that allows the inner space of the image forming apparatus 100 to communicate with the outside thereof, an exhaust fan 301, which is an exhaust unit, provided in the exhaust duct 32, a drive unit 302, and an exhaust control unit 303.

The exhaust fan 301 discharge the air in the image forming apparatus 100 to the outside of the image forming apparatus 100 by generating an air current flowing from the inside to the outside of the image forming apparatus 100. The drive unit 302 drives the exhaust fan 301.

With respect to the exhaust device 31 according to the embodiment, a platinum coating layer 321 including platinum nano-colloids is provided on at least a part of the inner wall face of the exhaust duct 32. In addition, it is preferable that the platinum coating layer 321 also is provided on even at least a part of the surface of the exhaust fan 301. The exhaust duct 32 is provided with a partition wall 33 partitioning a fan portion 32*a* as a space for installing the exhaust fan 301, and a duct portion 32*b* as the other space. In the embodiment, the partition walls 33 is provided with two partition walls consisting of a partition wall 33*a* close to the duct portion 32*b* and a partition wall 33*b* close to the fan portion 32*a*. The platinum coating layer 321 is provided on the front and back surfaces of the partition wall 33*a* and the surface of the partition wall 33*b* facing the exhaust fan 301.

With such a configuration, the ozone and discharge products generated from the charging unit 103*a* are absorbed with the air to the fan portion 32*a* and the duct portion 32*b* by the air current generated by the exhaust fan 301, they are decomposed by the platinum coating layer 321 formed on the surface of the inner wall of the duct portion 32*b*, and the surfaces of the partition wall 33*a*, the partition wall 33*b*, and the exhaust fan 301, and they are discharged as an air which does not include ozone out of the image forming apparatus 100.

The partition wall 33 is formed of two partition walls consisting of the partition wall 33*a* and the partition wall 33*b*, but the invention is not particularly limited thereto, and one partition wall may be provided and three or more partition walls 33 may be provided.

The exhaust control unit 303 provided in the exhaust device 31 controls the drive unit 302 to drive the exhaust fan 301 based on the instruction of the device control unit 21 of the image forming apparatus 100. The exhaust control unit 303 includes a job counting unit 303*a*, an image bearing member drive counting unit 303*b*, an initial condition setting unit 303*c*, and a continuation condition setting unit 303*d*.

The job counting unit 303*a* counts the number of printing copies (the number of image formation) of one job performed onto the recording sheet of paper by the image forming units pa to pd of the image forming apparatus 100. The image bearing member drive counting unit 303*b* integrates the count values counted by the job counting unit 303*a* from the point in time when starting the use of the photoreceptors 101*a* to 101*d* which are image bearing members, and calculates the number of driving times of the photoreceptors 101*a* to 101*d*. When the photoreceptors 101*a* to 101*d* are rotated a plurality of times with respect to one recording sheet of paper, the image bearing member drive counting unit 303*b* multiplies the count value counted by the job counting unit 303*a* by the number of rotations per one unit to calculate the number of driving times of the photoreceptors 101*a* to 101*d*.

The initial condition setting unit 303*c* sets an initial drive output value of the exhaust fan 301 at the time of starting the printing operation (image forming operation) in the image forming units pa to pd based on the number of driving times of the photoreceptors 101*a* to 101*d* calculated by the image bearing member drive counting unit 303*b*. In the exhaust device 31, the drive unit 302 drives the exhaust fan 301 with the initial drive output value set by the initial condition setting unit 303*c* to start to discharge the air in the image forming apparatus 100. The initial condition setting unit 303*c* may set the initial drive output value of the exhaust fan 301 in consideration of the use circumstance conditions (temperature condition, humidity condition, etc.) of the image forming apparatus 100 as well as the number of drive rotations of the photoreceptors 101*a* to 101*d*.

The deterioration degree of the image quality of printing such as pinhole caused by the ozone and discharge products in the image forming apparatus 100 is not only varied according to the number of printing copies of one job, but also is varied depending on the deterioration degree of the photoreceptors 101*a* to 101*d*. For this reason, the deterioration of image quality of printing caused by the ozone and discharge products cannot sufficiently suppress only by controlling the exhaust fan 301 to be driven according to the number of printing copies of one job. On the contrary, in order to sufficiently suppress the deterioration of image quality of printing without considering the deterioration degree of the photoreceptors 101*a* to 101*d*, it is necessary to start to drive the exhaust fan 301 with a drive output value set high to obtain high exhaust capability. Accordingly, the unnecessary power consumption cannot be suppressed and noise may get larger.

Hereupon, in the exhaust device 31 according to the embodiment, the drive unit 302 drives the exhaust fan 301 with the initial drive output value set by the initial condition setting unit 303*c* to start to discharge the air in the image forming apparatus 100. Accordingly, the discharge capability at the time of starting the printing operation is controlled according to the deterioration degree of the photoreceptors 101*a* to 101*d*, the deterioration of image quality of printing varied depending on the deterioration degree of the photoreceptors 101*a* to 101*d* this can be suppressed, the unnecessary power consumption can be suppressed, and the noise can be reduced.

It is preferable that the initial condition setting unit 303*c* sets the initial drive output value of the exhaust fan 301 to raise the exhaust capability of the exhaust fan 301 in a stepwise fashion as the calculation value calculated by the image bearing member drive counting unit 303*b* gets larger. Accordingly, the exhaust device 31 can keep the image quality of printing, the deterioration of which gets larger according to the deterioration of the photoreceptors 101*a* to 101*d*, with high quality.

Specifically, the initial condition setting unit 303*c* reads the drive output value corresponding to the number of driving times of the photoreceptors 101*a* to 101*d* from the initial condition table stored in advance in the storage unit 22, and sets the drive output value as the initial drive output value of the exhaust fan 301 at the time of starting the printing operation. Table 1 shows an example of the initial condition table.

TABLE 1

| Photoreceptor classification | Number of driving times of photoreceptor | Initial drive output value (W) |
|---|---|---|
| Initial photoreceptor | 0 or more and less than 35000 | 2.1 |
| Middle photoreceptor | 35000 or more and less than 50000 | 2.1 |
| Later photoreceptor | 50000 or more | 3.0 |

As shown in Table 1, the number of driving times of the photoreceptors 101*a* to 101*d* at the point in time when the use starts is classified into three classifications (Initial photoreceptor, Middle photoreceptor, and Later photoreceptor), and the initial drive output value is determined for each classification.

When the initial drive output value is set by the initial condition setting unit 303*c*, selection among the initial drive output values classified into the three classifications is carried out corresponding to the number of driving times of the photoreceptors 101*a* to 101*d*, and initial drive output value is set.

In Table 1, the initial drive output value corresponding to the number of driving times of the photoreceptor of 0 or more and less than 35000 is 2.1 W, the initial drive output value corresponding to the number of driving times of the photoreceptor of 35000 or more and less than 50000 is 2.1 W, and the initial drive output value corresponding to the number of driving times of the photoreceptor of 50000 or more is 3.0 W.

In the initial condition table shown in Table 1, the number of driving times of the photoreceptors 101*a* to 101*d* is classified into the three classifications, but the number of classifications is not limited thereto.

In the exhaust device 31, the drive unit 302 drives the exhaust fan 301 with the initial drive output value set by the initial condition setting unit 303*c* from the point in time when starting the printing operation to the point in time when ending the printing operation in the image forming units pa to pd. However, when the number of printing copies exceeds a predetermined threshold value (e.g., 100) in the course of the printing operation, the drive output value of the exhaust fan 301 may be changed and set to raise the exhaust capability of the exhaust fan 301.

Accordingly, the exhaust device 31 can efficiently discharge the ozone and discharge products, which is increased as the number of printing copies gets larger, out of the image forming apparatus 100 in the course of the printing operation.

The continuation condition setting unit 303*d* sets a continuation drive condition at the time of continuously driving the exhaust fan 301 from the point in time when ending the printing operation in the image forming units pa to pd based on the count value of the number of printing copies of one job counted by the job counting unit 303*a*. In the exhaust device 31, the drive unit 302 drives the exhaust fan 301 with the continuation drive condition set by the continuation condition setting unit 303*d* to continuously discharge the air in the image forming apparatus 100 without stopping discharging the air even after the printing operation is ended. Accordingly, the exhaust capability of the exhaust device 31 from the point in time when ending the printing operation is controlled according to the number of printing copies, and the deterioration of image quality of printing varied according to the number of printing copies and caused by the ozone and discharge products can be suppressed.

It is preferable that the continuation condition setting unit 303*d* sets the continuation drive condition of the exhaust fan 301 to raise the exhaust capability of the exhaust fan 301 in a stepwise fashion as the count value of the number of printing copies counted by the job counting unit 303*a* gets larger. Accordingly, the exhaust device 31 can keep the image quality of printing, the deterioration degree of which is increased as the number of printing copies gets larger, with high quality.

Specifically, the continuation condition setting unit 303*d* may set the continuation drive time of continuously driving the exhaust fan 301 from the point in time when the printing operation ends, as the continuation drive condition, and the drive unit 302 may drive the exhaust fan 301 during the set continuation drive time with the initial drive output value. Accordingly, the exhaust device 31 can suppress the deterioration of image quality of printing varied according to the number of printing copies and caused by the ozone and discharge products, with a simple configuration of turning on or off the drive of the exhaust fan 301.

In this case, the continuation condition setting unit 303*d* reads the continuation drive time corresponding to the number of printing copies of one job from the continuation condition table stored in advance in the storage unit 22, and sets the continuation drive time as the drive time of continuously driving the exhaust fan 301 from the time of ending the printing operation. Table 2 shows an example of the continuation condition table used in the case where the continuation condition setting unit 303*d* sets the continuation drive time as the continuation drive condition.

TABLE 2

| Job classification | Number of printing copies | Continuation drive time (sec) |
|---|---|---|
| Light job | 0 or more and 100 or less | 30 |
| Middle job | 101 or more and 500 or less | 60 |
| Heavy job | 501 or more | 120 |

As shown in Table 2, the number of printing copies is classified into three classifications (Light job, Middle job, and Heavy job), and the continuation drive time is determined for each classification.

When the continuation drive time is set by the continuation condition setting unit 303*d*, selection among the continuation drive times classified into the three classifications is carried out according to the number of printing copies in the image forming units pa to pd, and the continuation drive time is set.

In Table 2, the continuation drive time corresponding to the number of printing copies of 0 or more and 100 or less is 30 seconds, the continuation drive time corresponding to the number of printing copies of 101 or more and 500 or less is 60 seconds, and the continuation drive time corresponding to the number of printing copies of 501 or more is 120 seconds.

In the continuation condition table shown in Table 2, the number of printing copies is classified into the three classifications, but the number of classifications is not limited thereto.

The continuation condition setting unit 303*d* may set the continuation drive output value of the exhaust fan 301 as the continuation driving condition, and the drive unit 302 may drive the exhaust fan 301 with the set continuation drive output value. Accordingly, the exhaust device 31 has a configuration capable of controlling the exhaust capability of the exhaust fan 301 according to the setting of the continuation drive output value, and can suppress the deterioration of image quality of printing varied according to the number of printing copies and caused by the ozone and discharge products.

In this case, the continuation condition setting unit 303*d* reads the continuation drive output value corresponding to the number of printing copies of one job from the continuation condition table stored in advance in the storage unit 22, and sets the continuation drive output value as the drive output value at the time of continuously driving the exhaust fan 301 from the point in time when the printing operation ends. The continuation drive time of driving the exhaust fan 301 with the set continuation drive output value is a predetermined time, and is regular and not related to the number of printing copies.

Table 3 shows an example of the continuation condition table used in the case where the continuation condition setting unit 303*d* sets the continuation drive output value as the continuation drive condition.

TABLE 3

| Job classification | Number of printing copies | Continuation drive output value (W) |
|---|---|---|
| Light job | 0 or more and 100 or less | 2.1 |
| Middle job | 101 or more and 500 or less | 3.0 |
| Heavy job | 501 or more | 6.0 |

As shown in Table 3, the number of printing copies is classified into three classifications (Light job, Middle job, and Heavy job), and the continuation drive output value is determined for each classification.

When the continuation drive output value is set by the continuation condition setting unit 303*d*, selection among the continuation drive output values classified into the three classifications is carried out according to the number of printing copies in the image forming units pa to pd, and the continuation drive output value is set.

In Table 3, the continuation drive output value corresponding to the number of printing copies of 0 or more and 100 or less is 2.1 W, the continuation drive output value corresponding to the number of printing copies of 101 or more and 500 or less is 3.0 W, and the continuation drive output value corresponding to the number of printing copies of 501 or more is 6.0 W.

In the continuation condition table shown in Table 3, the number of printing copies is classified into the three classifications, but the number of classifications is not limited thereto.

The continuation condition setting unit 303*d* may set the continuation drive time of continuously driving the exhaust fan 301 from the point in time when ending the printing operation and the continuation drive output, value of the exhaust fan 301, as the continuation drive conditions. In this case, the drive unit 302 drives the exhaust fan 301 during the set continuation drive time with the set continuation drive output value. Accordingly, the exhaust device 31 has a configuration capable of controlling the exhaust capability of the exhaust fan 301 according to a plurality of settings of the continuation drive time and the continuation drive output value, and can efficiently suppress the deterioration of image quality of printing varied according to the number of printing copies and caused by the ozone and discharge products.

In this case, the continuation condition setting unit 303*d* reads the continuation drive time and the continuation drive output value corresponding to the number of printing copies from the continuation condition table stored in advance in the storage unit 22, and sets the drive time and the drive output value as the drive time and drive output value of continuously driving the exhaust fan 301 from the time of ending the printing operation. Table 4 shows an example of the continuation condition table used in the case where the continuation condition setting unit 303*d* sets the continuation drive time and the continuation drive output value as the continuation drive conditions.

TABLE 4

| Job classification | Number of printing copies | Continuation drive time (sec) | Continuation drive output value (W) |
|---|---|---|---|
| Light job | 0 or more and 100 or less | 30 | 2.1 |
| Middle job | 101 or more and 500 or less | 60 | 3.0 |
| Heavy job | 501 or more | 120 | 6.0 |

As shown in Table 4, the number of printing copies is classified into three classifications (Light job, Middle job, and Heavy job), and the continuation drive time and the continuation drive output value are determined for each classification.

When the continuation drive time and the continuation drive output value are set by the continuation condition setting unit 303*d*, selection among the continuation drive times and the continuation drive output values classified into the three classifications is carried out according to the number of printing copies in the image forming units pa to pd, and the continuation drive time and the continuation drive output value are set.

In Table 4, the continuation drive output value is 2.1 W when the continuation drive time corresponding to the number of printing copies of 0 or more and 100 or less is 30 seconds, the continuation drive output value is 3.0 W when the continuation drive time corresponding to the number of printing copies of 101 or more and 500 or less is 60 seconds, and the continuation drive output value is 6.0 W when the continuation drive time corresponding to the number of printing copies of 501 or more is 120 seconds.

In the continuation condition table shown in Table 4, the number of printing copies is classified into the three classifications, but the number of classifications is not limited thereto.

Figure 5A:
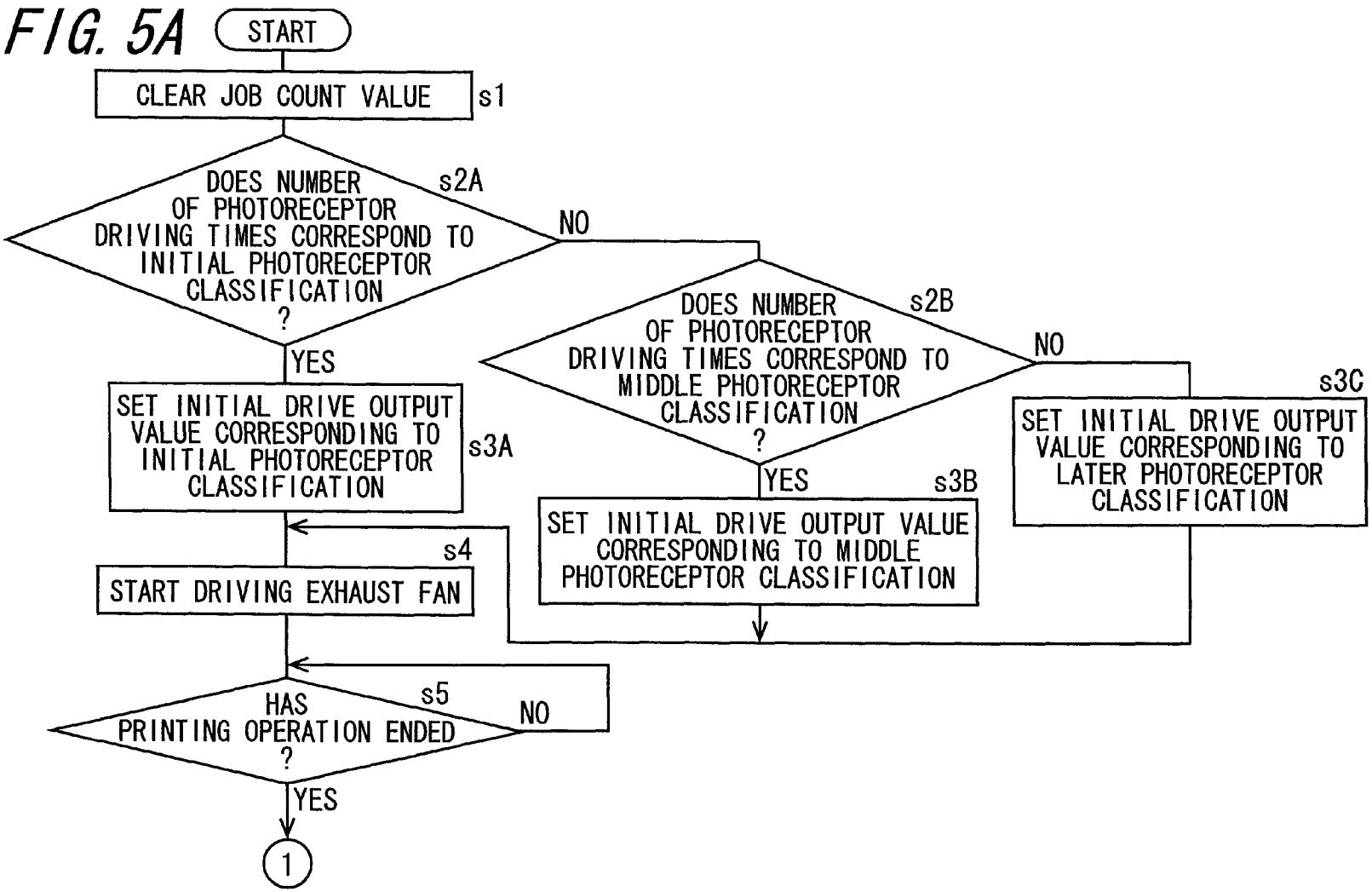
FIGS. 5A and 5B are flowcharts illustrating a first example of the operation of the exhaust device controlled by an exhaust control unit.
Figure 5B:
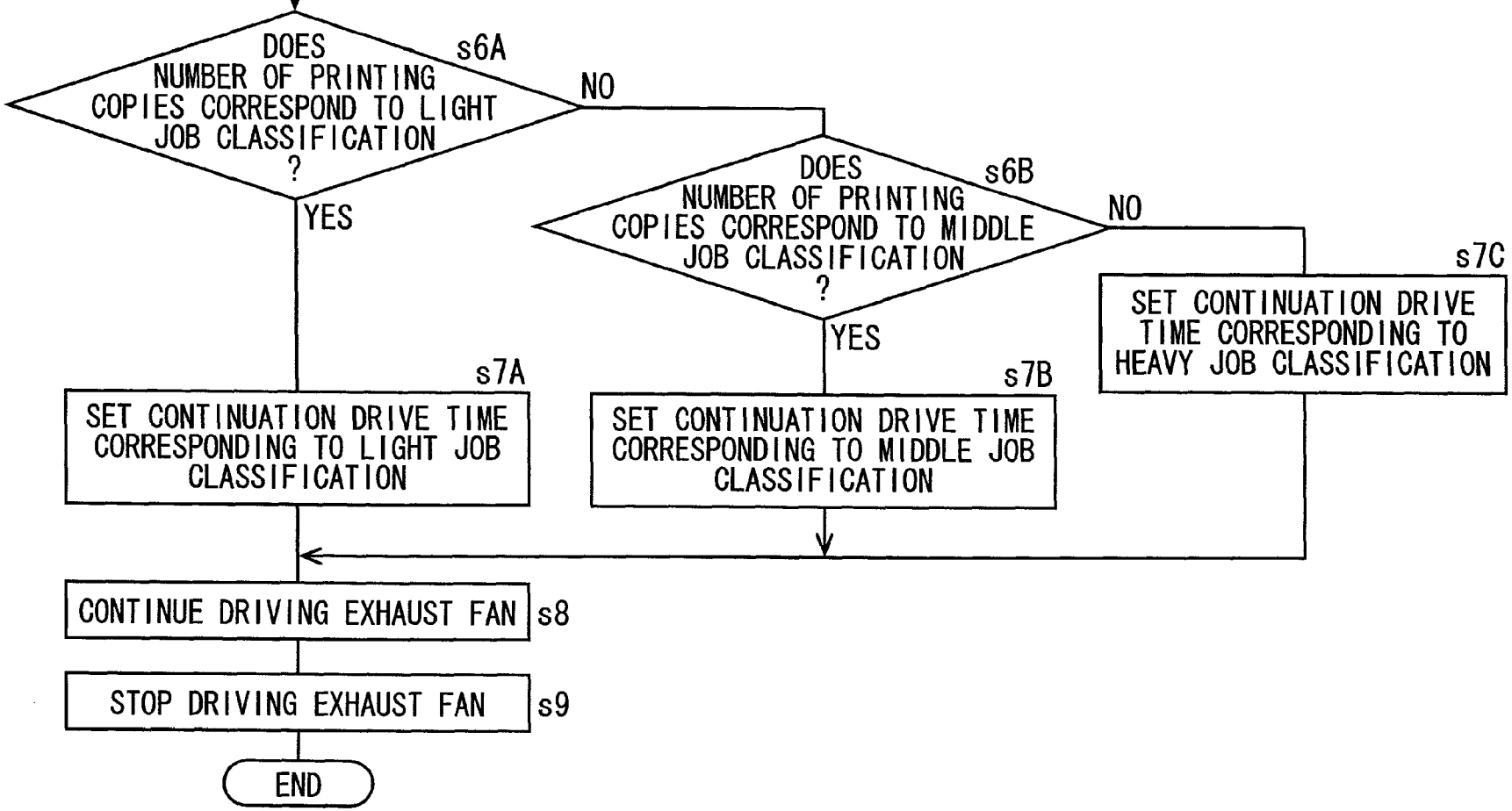

Then, the operation of the exhaust device 31 controlled by the exhaust control unit 303 will be described with reference to FIGS. 5A and 5B. FIGS. 5A and 5B are flowcharts illustrating a first example of the operation of the exhaust device 31 controlled by the exhaust control unit 303. In the first example of the operation of the exhaust device 31 controlled by the exhaust control unit 303, the initial condition setting unit 303*c* reads the drive output value corresponding to the number of driving times of the photoreceptors 101*a* to 101*d* from the initial condition table shown in Table 1 stored in advance in the storage unit 22, and sets the drive output value, as the initial drive output value of the exhaust fan 301 at the time of the starting the printing operation. The continuation condition setting unit 303*d* reads the continuation drive time corresponding to the number of printing copies from the continuation condition table shown in Table 2 stored in advance in the storage unit 22, and sets the drive time of continuously driving the exhaust fan 301 from the point in time when the printing operation ends.

First, at Step s1, the job counting unit 303*a* of the exhaust control unit 303 clears a job count value such that the count value is "0".

At Step s2A, the initial condition setting unit 303*c* determines whether or not the number of driving times of the photoreceptor stored in the storage unit 22 and calculated by the image bearing member drive counting unit 303*b* at the time of the previous printing operation corresponds to the initial photoreceptor classification in the initial condition table shown in Table 1. When it is determined that the number of driving times corresponds to the initial photoreceptor classification, the procedure proceeds to Step s3A. When it is determined that the number of driving times does not correspond to the initial photoreceptor classification, the procedure proceeds to Step s2B.

At Step s3A, the initial condition setting unit 303*c* reads the initial drive output value corresponding to the initial photoreceptor classification from the initial condition table shown in Table 1, and sets the drive output value at the time of starting to drive the exhaust fan 301.

At Step s2B, the initial condition setting unit 303*c* determines whether or not the number of driving times of the photoreceptor corresponds to the middle photoreceptor classification. When it is determined that the number of driving times corresponds to the middle photoreceptor classification, the procedure proceeds to Step s3B. When it is determined that the number of driving times does not correspond to the middle photoreceptor classification, the procedure proceeds to Step s3C.

At Step s3B, the initial condition setting unit 303*c* reads the initial drive output value corresponding to the middle photoreceptor classification from the initial condition table shown in Table 1, and sets the drive output value at the time of starting to drive the exhaust fan 301. At Step s3C, the initial condition setting unit 303*c* reads the initial drive output value corresponding to the later photoreceptor classification from the initial condition table shown in Table 1, and sets the drive output value at the time of starting to drive the exhaust fan 301.

Then, at Step s4, the exhaust control unit 303 controls the drive unit 302 to start to drive the exhaust fan 301 with the initial drive output value set at any step of Steps s3A to s3C by the initial condition setting unit 303*c*.

At Step s5, the exhaust control unit 303 determines whether or not the printing operation in the image forming units pa to pd is completed. When it is determined that the printing operation is completed, the procedure proceeds to Step s6A. At this time, the image bearing member drive counting unit 303*b* integrates the count values counted by the job counting unit 303*a* to calculate the number of driving times of the photoreceptor, and stores the calculation values in the storage unit 22.

At Step s6A, the continuation condition setting unit 303*d* determines whether or not the number of printing copies counted by the job counting unit 303*a* corresponds to the light job classification in the continuation condition table shown in Table 2. When it is determined that the number of printing copies corresponds to the light job classification, the procedure proceeds to Step s7A. When it is determined that the number of printing copies does not correspond to the light job classification, the procedure proceeds to Step s6B.

At Step s7A, the continuation condition setting unit 303*d* reads the continuation drive time corresponding to the light job classification from the continuation condition table shown in Table 2, and sets the drive time of continuously driving the exhaust fan 301 from the point in time when the printing operation ends.

At Step s6B, the continuation condition setting unit 303*d* determines whether or not the number of printing copies counted by the job counting unit 303*a* corresponds to the middle job classification. When it is determined that the number of printing copies corresponds to the middle job classification, the procedure proceeds to Step s7B. When it is determined that the number of printing copies does not correspond to the middle job classification, the procedure proceeds to Step s7C.

At Step s7B, the continuation condition setting unit 303*d* reads the continuation drive time corresponding to the middle job classification from the continuation condition table shown in Table 2, and sets the drive time of continuously driving the exhaust fan 301 from the point in time when the printing operation ends. At Step s7C, the continuation condition setting unit 303*d* reads the continuation drive time corresponding to the heavy job classification from the continuation condition table shown in Table 2, and sets the drive time of continuously driving the exhaust fan 301 from the point in time when the printing operation ends.

Then, at Step s8, the exhaust control unit 303 controls the drive unit 302 to continue driving the exhaust fan 301 with the continuation drive time set at any step of Steps s7A to s7C by the continuation condition setting unit 303*d*.

At Step s9, the exhaust control unit 303 controls the drive unit 302 to stop the driving of the exhaust fan 301 at the point in time when the continuation drive time set by the continuation condition setting unit 303*d* has elapsed.

As described above, the exhaust control unit 303 controls the drive of the exhaust fan 301 to start with the initial drive output value corresponding to the number of driving times of the photoreceptor, and controls the continuous drive of the exhaust fan 301 at the continuation drive time corresponding to the number of printing copies. Accordingly, the deterioration of image quality of printing varied according to the number of printing copies and caused by the ozone and discharge products can be suppressed, and the unnecessary power consumption can be suppressed.

Figure 6A:
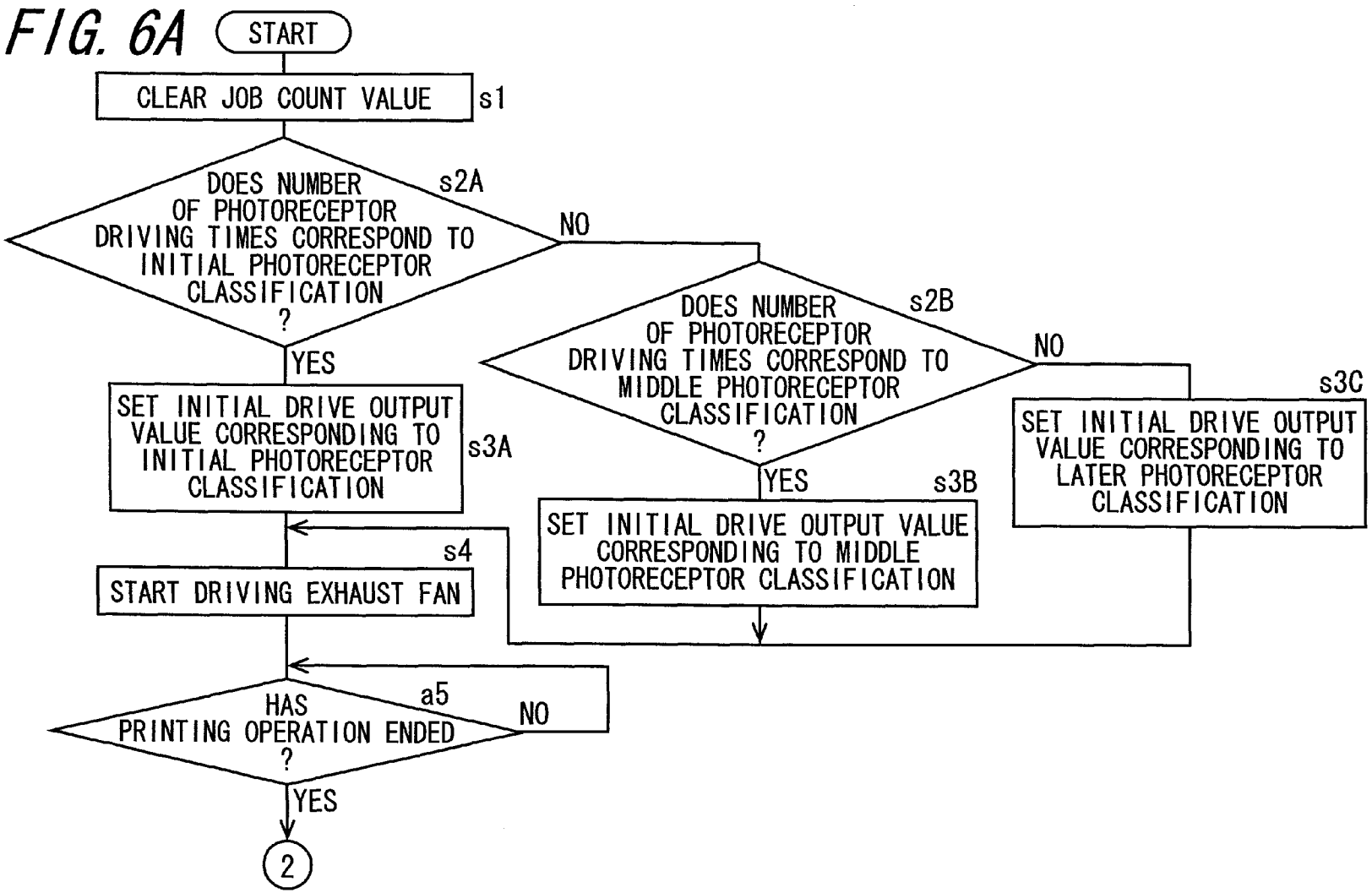
FIGS. 6A and 6B are flowcharts illustrating a second example of the operation of the exhaust device controlled by the exhaust control unit.
Figure 6B:
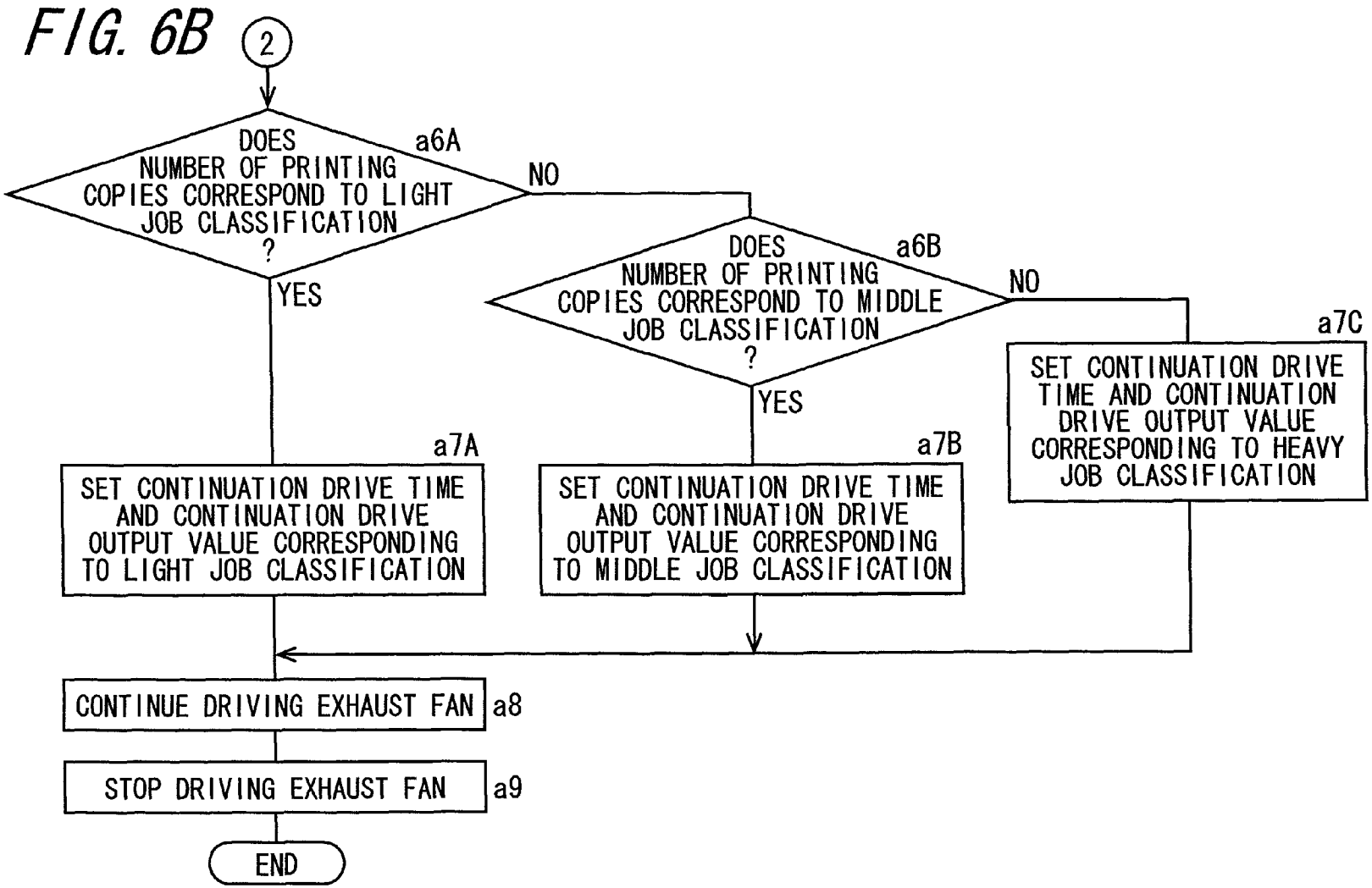

FIGS. 6A and 6B are flowcharts illustrating a second example of the operation of the exhaust device 31 controlled by the exhaust control unit 303. In the second example of the operation of the exhaust device 31 controlled by the exhaust control unit 303, in the same manner as the first example of the operation control shown in FIG. 5, the initial condition setting unit 303*c* sets the initial drive output value through Step s1 to Step s4, and driving of the exhaust fan 301 is started.

At Step a5, the exhaust control unit 303 determines whether or not the printing operation in the image forming units pa to pd is completed. When it is determined that the printing operation is completed, the procedure proceeds to Step a6A. At this time, the image bearing member drive counting unit 303*b* integrates the count values counted by the job counting unit 303*a* to calculate the number of driving times of the photoreceptor, and stores the calculation values in the storage unit 22.

At Step a6A, the continuation condition setting unit 303*d* determines whether or not the number of printing copies counted by the job counting unit 303*a* corresponds to the light job classification in the continuation condition table shown in Table 4. When it is determined that the number of printing copies corresponds to the light job classification, the procedure proceeds to Step a7A. When it is determined that the number of printing copies does not correspond to the light job classification, the procedure proceeds to Step a6B.

At Step a7A, the continuation condition setting unit 303*d* reads the continuation drive time and the continuation drive output value corresponding to the light job classification from the continuation condition table shown in Table 4, and sets the drive time and the drive output value at the time of continuously driving the exhaust fan 301 from the point in time when the printing operation ends.

At Step a6B, the continuation condition setting unit 303*d* determines whether or not the number of printing copies counted by the job counting unit 303*a* corresponds to the middle job classification. When it is determined that the number of printing copies corresponds to the middle job classification, the procedure proceeds to Step a7B. When it is determined that the number of printing copies does not correspond to the middle job classification, the procedure proceeds to Step a7C.

At Step a7B, the continuation condition setting unit 303*d* reads the continuation drive time and the continuation drive output value corresponding to the middle job classification from the continuation condition table shown in Table 4, and sets the drive time and the drive output value at the time of continuously driving the exhaust fan 301 from the point in time when the printing operation ends. At Step a7C, the continuation condition setting unit 303*d* reads the continuation drive time and the continuation drive output value corresponding to the heavy job classification from the continuation condition table shown in Table 4, and sets the drive time and the drive output value at the time of continuously driving the exhaust fan 301 from the point in time when the printing operation ends.

Then, at Step a8, the exhaust control unit 303 controls the drive unit 302 to continue driving the exhaust fan 301 with the continuation drive time and the continuation drive output value set at any step of Steps a7A to a7C by the continuation condition setting unit 303*d*.

At Step a9, the exhaust control unit 303 controls the drive unit 302 to stop the driving of the exhaust fan 301 at the point in time when the continuation drive time set by the continuation condition setting unit 303*d* has elapsed.

As described above, the exhaust control unit 303 controls the drive of the exhaust fan 301 to start with the initial drive output value corresponding to the number of driving times of the photoreceptor, and controls the continuous drive of the exhaust fan 301 according to the plurality of settings of the continuation drive time and the continuation drive output value. Accordingly, the deterioration of image quality of printing varied according to the number of printing copies and caused by the ozone and discharge products can be suppressed, and the unnecessary power consumption can be suppressed.

(Control Program, and Recording Medium)

As another embodiment of the invention, there are provided a control program for causing a computer to function as the exhaust control unit 303 of the exhaust device 31, and a computer-readable recording medium on which program codes (execution type program, intermediate code program, and source program) of the control program are recorded. According to the embodiment, a computer (or CPU (Central Processing Unit)) or an MPU (Micro Processing Unit) provided in the image forming apparatus 100 reads the program codes recorded on the recording medium and executes the commands of the control program. As described above, the computer executes the commands of the control program, thereby realizing the operation of the exhaust device 31 suppressing the deterioration of image quality of printing caused by the ozone and discharge products and suppressing the unnecessary power consumption.

As the recording medium for recording the program codes of the control program, for example, a tape such as a magnetic tape and a cassette tape; a disc group of a magnetic disc such as a floppy disc (registered trademark) and a hard disc, and an optical disc such as a CD-ROM (Compact Disc-Read Only Memory), an MO (Magneto Optical disc), an MD (Mini Disc), a DVD (Digital Versatile Disc), a CD (Compact Disc-Recordable), and a Blu-ray; a card such as an IC (Integrated Circuit) card (including a memory card) and an optical card; or a semiconductor memory such as a mask ROM, an EPROM (Erasable Programmable Read Only Memory), an EEPROM (Electrically Erasable Programmable Read Only Memory) and a flash ROM, can be used.

The image forming apparatus 100 may be configured to be connectable to a communication network such that the program codes of the control program are supplied to the computer through the communication network. The communication network is not particularly limited, for example, an internet, an intranet, an extranet, a LAN (Local Area Network), an ISDN (Integrated Service Digital Network), a VAN (Value-added Network), a CATV (Community Antenna Television) communication network, a virtual private network, a telephone line network, a mobile communication network, a satellite communication network, and the like can be used. The transmission medium constituting the communication network is not particularly limited, for example, wired lines such as an IEEE 1394 (Institute of Electrical and Electronic Engineers 1394), a USB (Universal Serial Bus), a power line carrier, a cable TV line, a telephone line, and an ADSL (Asymmetric Digital Subscriber Line) line, and radio waves such as an infrared ray such as IrDA (Infrared Data Association) or a remote control, a Bluetooth (registered trademark), an 802.11 radio wave, an HDR (High Data Rate), a mobile telephone network, a satellite circuit, and a terrestrial digital network are usable. Note that, the invention may be realized also in a form of a computer data signal embedded in a carrier wave in which the program code of the control program is embodied by an electronic transmission.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An exhaust device provided in an image forming apparatus having an image forming unit which form an image on a recording material by transferring a toner image borne on an image bearing member to the recording material, the exhaust device comprising:

an exhaust unit that discharge air in the image forming apparatus to an outside of the image forming apparatus by generating an air current flowing from an inside to an outside of the image forming apparatus;

a drive unit that drives the exhaust unit; and an exhaust control unit that controls the drive unit to drive the exhaust unit, the exhaust control unit including:

a job counting unit that counts a number of image formation of one job in an image forming operation performed onto the recording material by the image forming unit, an image bearing member drive counting unit that integrates count values counted by the job counting unit from a point in time when starting the use of the image bearing member and calculates a number of driving times of the image bearing member, and an initial condition setting unit that sets an initial drive output value of the exhaust unit driven by the drive unit at a time of starting the image forming operation performed onto the recording material by the image forming unit based on a calculation value calculated by the image bearing member drive counting unit, the exhaust unit being controlled to be driven with the initial drive output value set by the initial condition setting unit at the time of starting the image forming operation performed onto the recording material by the image forming unit.

2. The exhaust device of claim 1, wherein the exhaust control unit further includes a continuation condition setting unit that sets a continuation drive condition at a time of continuously driving the exhaust unit from a point in time when ending an image forming operation performed onto the recording material by the image forming unit based on a count value counted by the job counting unit, and controls the exhaust unit to be continuously driven from the point in time when ending the image forming operation under the continuation drive condition set by the continuation condition setting unit.

3. The exhaust device of claim 2, wherein the initial condition setting unit sets the initial drive output value of the exhaust unit driven by the drive unit to raise the exhaust capability of the exhaust unit in a stepwise fashion as the calculation value calculated by the image bearing member drive counting unit gets larger, and the continuation condition setting unit sets the continuation drive condition of the exhaust unit driven by the drive unit to raise the exhaust capability of the exhaust unit in a stepwise fashion as the count value counted by the job counting unit gets larger.

4. The exhaust device of claim 2, wherein the continuation condition setting unit sets the continuation drive time of continuously driving the exhaust unit from the point in time when ending the image forming operation performed onto the recording material by the image forming unit, as the continuation drive condition.

5. The exhaust device of claim 2, wherein the continuation condition setting unit sets the continuation drive output value of the exhaust unit driven by the drive unit at the time of continuously driving the exhaust unit from the point in time when ending the image forming operation performed onto the recording material by the image forming apparatus, as the continuation drive condition.

6. The exhaust device of claim 2, wherein the continuation condition setting unit sets the continuation drive time of continuously driving the exhaust unit from the point in time when ending the image forming operation performed onto the recording material by the image forming unit, and the continuation drive output value of the exhaust unit driven by the drive unit, as the continuation drive condition.

7. An image forming apparatus provided with the exhaust device of claim 1.

8. A computer-readable recording medium on which a control program for causing a computer to function as the exhaust control unit provided in the exhaust device of claim 1 is recorded.

* * * * *